US011772864B2

(12) United States Patent
Anand

(10) Patent No.: US 11,772,864 B2
(45) Date of Patent: Oct. 3, 2023

(54) COUNTERFEIT, TAMPER AND REFILL EVIDENT PACKAGING

(71) Applicant: Ashish Anand, Bangalore (IN)

(72) Inventor: Ashish Anand, Bangalore (IN)

( * ) Notice: Subject to any disclaimer, the term of this patent is extended or adjusted under 35 U.S.C. 154(b) by 11 days.

(21) Appl. No.: 17/337,474

(22) Filed: Jun. 3, 2021

(65) Prior Publication Data

US 2021/0284408 A1 Sep. 16, 2021

Related U.S. Application Data

(62) Division of application No. 16/337,928, filed on Mar. 29, 2019, now abandoned.

(30) Foreign Application Priority Data

Oct. 17, 2016 (IN) ..... 201641035475

(51) Int. Cl.

| | |
|---|---|
| ***B65D 55/06*** | (2006.01) |
| ***B65D 71/02*** | (2006.01) |
| ***B65D 5/42*** | (2006.01) |
| ***B65D 51/20*** | (2006.01) |
| ***B65D 51/24*** | (2006.01) |

(52) U.S. Cl.

CPC ..... *B65D 55/06* (2013.01); *B65D 5/4204* (2013.01); *B65D 51/20* (2013.01); *B65D 51/245* (2013.01); *B65D 55/066* (2013.01); *B65D 71/02* (2013.01); *B65D 2203/02* (2013.01); *B65D 2203/10* (2013.01); *B65D 2251/009* (2013.01); *B65D 2251/0015* (2013.01); *B65D 2401/00* (2020.05)

(58) Field of Classification Search

CPC ..... B65D 53/00; B65D 53/04; B65D 5/4204; B65D 41/325; B65D 41/34; B65D 43/0235; B65D 51/20; B65D 51/245; B65D 55/066; B65D 55/06; B65D 71/02; B65D 2401/00; B65D 2203/02; B65D 2203/10; B65D 2251/0015; B65D 2251/009; B65D 55/0854

USPC ..... 220/258.3

See application file for complete search history.

(56) References Cited

U.S. PATENT DOCUMENTS

| | | | | |
|---|---|---|---|---|
| 2005/0023173 | A1* | 2/2005 | Paoletti | B65D 55/0854 215/230 |
| 2011/0024420 | A1* | 2/2011 | King | B65D 51/18 220/254.8 |
| 2013/0008962 | A1* | 1/2013 | Anand | G06V 10/225 235/487 |
| 2016/0280431 | A1* | 9/2016 | Carvajal | B65D 51/245 |

* cited by examiner

*Primary Examiner* — William V Gilbert

(57) ABSTRACT

A container (200) is provided. The container (200) comprises a mouth (202), a cap (204) for operably exposing or closing the mouth (202), a sealing layer (206) on top of the mouth (202) and a security label (208) which is scannable. At least a portion (204*a*) of the cap (204) is transparent. The security label (208) is disposed over the sealing layer (206) below the transparent cap (204) and the security label (208) is machine scannable.

2 Claims, 10 Drawing Sheets

COUNTERFEIT, TAMPER AND REFILL EVIDENT PACKAGING

BACKGROUND

Field

The subject matter in general relates to the field of security label. More particularly, but not exclusively, the subject matter relates to application of security label, which is scannable for at least tamper detection, to packages and containers.

Discussion of Related Art

Conventionally various types of packaging cartons and containers are used based on the goods to be accommodated and transported, and desired security against tampering and counterfeiting. Packaging containers or boxes can be of different types, such as, box and lid type, die-cut self-locking boxes, full overlap boxes, packaging cartons, packing wallets, self-locking boxes and trays. Likewise, containers or bottles may be categorized based on presence or absence of sealing layer over the mouth, wad in the cap and shrink-sleeve, among others. In several instances, these packages and containers have to be protected against tampering and counterfeiting. Even standard accessories applied on standard packaging for example smart tracking tags (NFC for example) or straps (strips that fastens objects) need security against counterfeit and tampering.

A conventional approach to detect tampering of packages is illustrated in prior art FIG. 1. In the instant figure, a packing carton/box 10 is illustrated. A tamper-evident tape 12 is used to seal the box 10 as illustrated in step 100. In case the tape 12 is stripped from the box 10, as illustrated in step 102, the tape 12 leaves marks 14 on the surface it was previously adhered to. Marks 14 are an indication that the tape has been stripped from the box 10. However, a person with malicious intent can remove the tape 12 and gain access to the inside of the box 10, and then replace another tape 18 identical to the original tape 12, as illustrated in step 104. Such an act may misguide the authorized recipient that the box 10 has been delivered without any tampering, and such belief may be further reinforced because the barcode 16 may be the one that is expected. Furthermore, such tampering will have to be visually inspected by human eye, and is prone to error due to lack of knowledge, concentration and attention to detail, among other factors.

The Author of this patent application had previously recognized the need for detecting tampering using machine scannable means, instead of human scanning. The Author went on to invent a security label and received a U.S. Pat. No. 9,361,532 (hereinafter US'532), which is herein incorporated by reference.

While the security label of US'532 enables tamper detection by machine vision scanning, there is a need to integrate the security label of US'532 or other security labels which are machine scannable for tamper detection, with, but not limited to, packages and containers exemplified earlier.

SUMMARY

An aspect provides a container comprising a mouth, a cap for operably exposing or closing the mouth, a sealing layer on top of the mouth and a security label which is scannable. At least a portion of the cap is transparent, the security label is disposed over the sealing layer below the transparent cap and the security label is machine scannable.

Another aspect provides a container comprising a mouth, a cap for operably exposing or closing the mouth, a sealing layer on top of the mouth and a security label which is scannable. At least a portion of the cap is transparent, the security label is integrated inside the cap and the security label is transferred along with the sealing layer over the mouth of the container during cap sealing process.

Yet another aspect provides a container comprising a mouth, a cap for operably exposing or closing the mouth, a sealing layer on top of the mouth and a security label which is scannable. At least a portion of the cap is transparent, the security label is integrated with the cap, the security label is machine scannable, a reference is provided on the sealing layer and the reference enables determination of spatial orientation of the security label for tamper evidence and counterfeit evidence.

Still another aspect provides a container comprising a mouth, a shrink sleeve and a security label which is scannable. The security label is disposed either on the container or on the shrink sleeve and the security label is machine scannable and indicates tampering despite same label is decoupled and applied again on same container or another container.

Still another aspect provides a container comprising a mouth, a cap for operably exposing or closing the mouth, a sealing layer and a security label which is scannable. The security label is disposed at least partially over the cap and the security label is machine scannable and indicates tampering despite same cap and same sealing layer is used again on same container or another container.

Still another aspect provides a packaging box comprising at least two internal closing flaps, at least one outer closing flap and at least one security label. The security label is scannable, the security label at least partially seals the internal closing flaps, the outer closing flap defines at least one transparent portion and at least a part of the security label is visible for scanning via the transparent portion.

Still another aspect provides a packaging container comprising of region with variable color-shift optical property. The variable data in encoded form for machine scan is disposed on the region with variable color-shift optical property. The variable data in encoded form is disposed with random spatial orientation and orientation is registered in database for subsequent authentication. Unique credential of packaging is based on color profile along one or more visually distinguished markers within the variable data in encoded form.

Still another aspect provides a packaging comprising a NFC tag and a security label. The security label is disposed over face-stock of the NFC tag and the security label is machine scannable using vision technology for tamper evidence and counterfeit evidence.

Still another aspect provides a packaging container comprising a strap passing through a groove, and a security label, which is machine scannable. The security label is disposed over at least a section of the groove and the strap.

Still another aspect provides a method of enabling detection of tampering via machine scanning. The method includes obtaining randomized orientation of a machine scan-able security label by disposing the security label inside a capping system of a container, such that once the cap is sealed, orientation of the security label is randomized.

BRIEF DESCRIPTION OF DIAGRAMS

This disclosure is illustrated by way of example and not limitation in the accompanying figures. Elements illustrated in the figures are not necessarily drawn to scale, in which like references indicate similar elements and in which:

FIG. 1 illustrates prior art packaging that attempts to limit tampering of packing carton/box 10;

FIGS. 2A (exploded view) and 2B (assembled view) illustrate a container 200 with a transparent cap 204 having a reference 210, and a security label 208 disposed over a sealing layer 206, which is covering the mouth 202 of the container, in accordance with an embodiment;

FIG. 3A illustrates the cap 204 having a reference 210, with the sealing layer 206 and the security label 208 integrated with the cap 204, before the cap 204 is engaged to the container 200 during the container 200 filling process in a manufacturing facility, in accordance with an embodiment;

FIG. 3B illustrates the cap 204 of FIG. 3A engaged to the container 200 during the container 200 filling process in a manufacturing facility, wherein the sealing layer 206 and the security label 208 are transferred to and over the mouth 202 of the container 200, in accordance with an embodiment;

FIG. 3C illustrates the cap 204 of FIG. 3B disengaged from the container 200 after the sealing layer 206 and the security label 208 are transferred to and over the mouth 202 of the container 200, in accordance with an embodiment;

FIG. 4A illustrates the security label 208 disposed on the top surface of the cap 204, and the reference 210 disposed on the sealing layer 206, in accordance with an embodiment;

FIG. 4B illustrates the security label 208 disposed under, but facing, the top surface of the cap 204, and the reference 210 disposed on the sealing layer 206, in accordance with an embodiment;

FIG. 4C illustrate a security label 206 with a hole at the center and the reference 210 disposed coincidingly with the hole, in accordance with an embodiment;

FIG. 5A illustrates a container 200 with shrink sleeve 502 spanning at least partially over cap 504, in accordance with an embodiment;

FIG. 5B illustrates the security label 208 disposed partially over the cap 504 and partially over the shrink sleeve 502, with the reference 210 provided over the shrink sleeve 502, in accordance with an embodiment;

FIG. 6 illustrates the reference 210 provide over the cap 504 and the security label 208 disposed on the shrink sleeve 502, in accordance with an embodiment;

FIG. 7A discloses a packing carton box 700 with the security label 208 sealing the internal closing flaps 702, in accordance with an embodiment;

FIG. 7B illustrates the box 700 of FIG. 7A, with the outer closing flap 704 in the closed position, wherein the security label 208 is visible through a transparent portion 708 provided in the outer closing flap 704, in accordance with an embodiment;

FIGS. 8A-8C illustrate packaging containers 800 having a region 802 with variable color-shift optical property, and matrix barcode 804 disposed over the region 802 at different orientations, in accordance with an embodiment;

FIG. 9 illustrates an integration 900 of the security label 208, an NFC tag 902 and an adhesive layer 904, in accordance with an embodiment;

DETAILED DESCRIPTION OF THE INVENTION

The following detailed description includes references to the accompanying drawings, which form part of the detailed description. The drawings show illustrations in accordance with example embodiments. These example embodiments are described in enough details to enable those skilled in the art to practice the present subject matter. However, it will be apparent to one of ordinary skill in the art that the present invention may be practiced without these specific details. In other instances, well-known methods, procedures and components have not been described in detail so as not to unnecessarily obscure aspects of the embodiments. The embodiments can be combined, other embodiments can be utilized or structural and logical changes can be made without departing from the scope of the invention. The following detailed description is, therefore, not to be taken as a limiting sense.

In this document, the terms "a" or "an" are used, as is common in patent documents, to include one or more than one. In this document, the term "or" is used to refer to a non-exclusive "or," such that "A or B" includes "A but not B," "B but not A," and "A and B," unless otherwise indicated.

Most of the embodiment in this disclosure have been described in the context of security label of US'532. However, in view of this disclosure, one of ordinary skill in the art will appreciate that other security labels, which are machine scannable for tamper evidence and/or counterfeit evidence, wherever feasible, may be used within the scope of the claims.

First Embodiment

Figure 1:
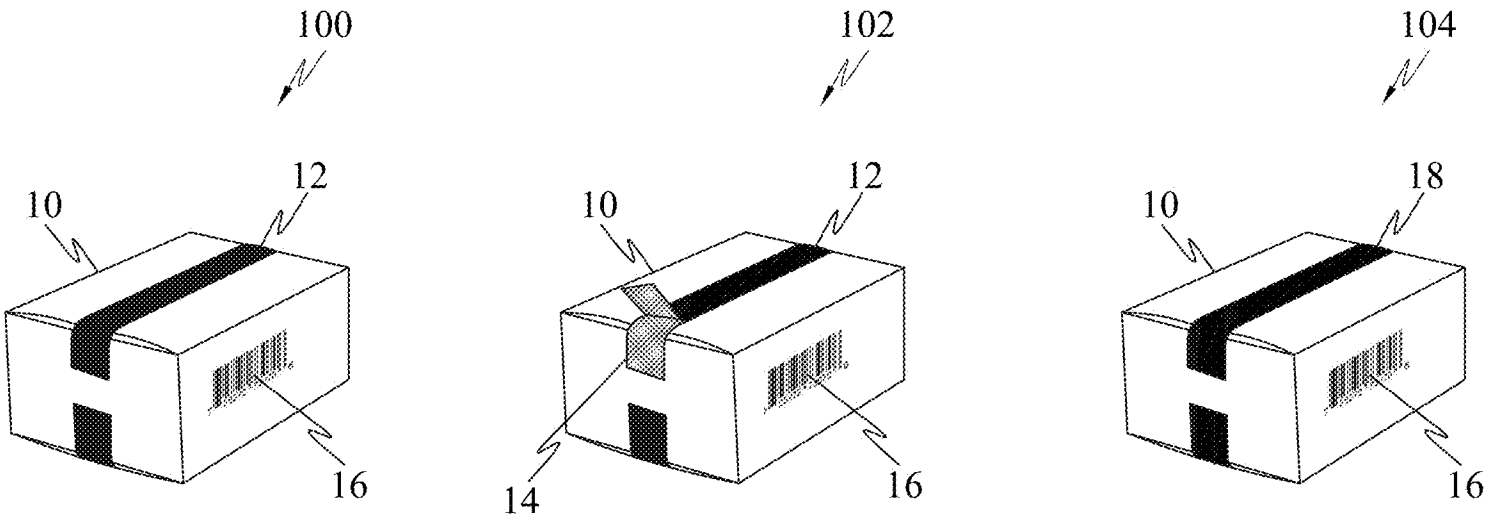
PRIOR ART FIG. 1
Figure 2B:
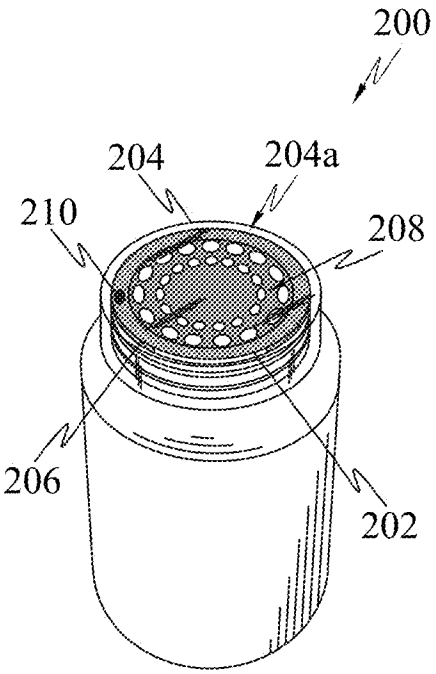
Figure 2A:
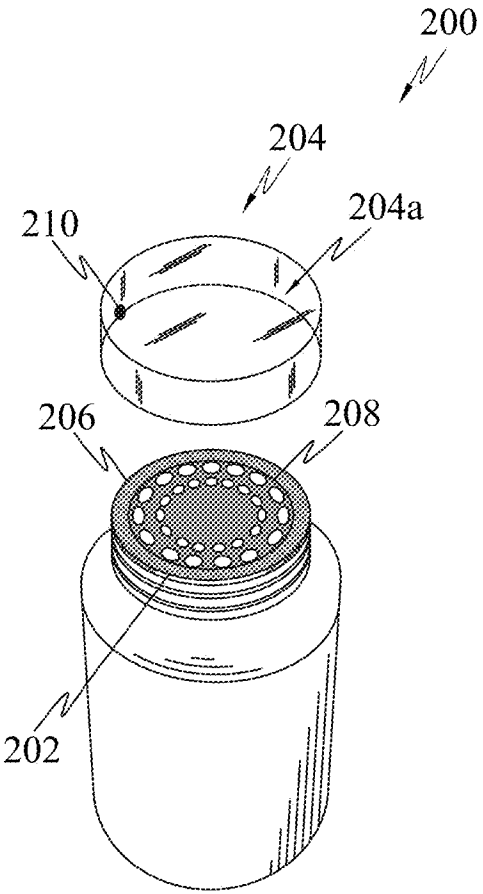

We now refer specifically to FIGS. 2A-2B, wherein a container 200 is disclosed. The container 200 includes a mouth 202 and a cap 204. The cap 204 is operable to expose or close the mouth 202. The container 200 further comprises a sealing layer 206. The sealing layer 206 is disposed on top of the mouth 202. The sealing layer 206 seals the mouth 202, and access to any item accommodated by the container 200 may be possible after breaching the sealing layer 206. Further, a security label 208 is disposed over the sealing layer 206. The security label 208 is machine scannable. In general, capping system comprises of cap and WAD (liner). In one example, WAD may be multi-layer structure comprising paper-pulp, wax, sealing foil and polymer film together as one unit inserted inside cap. During cap-closure on packaging-line, sealing-foil is transferred to container and top layer of liner remains inside cap. There is no control on orientation of individual WAD inside CAP and it is fully randomized. If sealing-layer and CAP/WAD together can be made machine scan-able, it can be leveraged as security feature.

The cap 204 is such that at least a portion, such as a top portion 204*a* (or a portion of the top portion 204*a*) is transparent. Therefore, the security label 208, which may be beneath the cap 204 and over the sealing layer 206, will be available for machine vision scanning.

It may be noted that the phrase "transparent" is not limited to transparency in terms of human eye, but extends to transparency for machine scanning. As such, the cap 204 may appear to be translucent or opaque to human eye, but may be transparent to a machine, since the characteristics of the security label 208 is available for scanning through the cap 204.

The container 200 further comprises at least one reference 210. The reference 210 may be provided on a surface other than the security label 208. The reference 208 enables determination of spatial orientation of the security label 208 with respect to the reference 208. Therefore, any change in the spatial relationship between the security label 208 and the reference 210 indicates tampering. The reference 210 is provided in the cap 204. The reference may be provided on the top surface or bottom surface of the cap 204. The cap may be sealed to prevent free play, thereby preventing any change in spatial orientation, unless seal is broken.

As such, in practice, the spatial orientation of the security label 208 with respect to the reference 208 may be determined after the cap 204 is engaged to the container 200. Thereafter, when the container 200 has be checked for tampering, machine scanning, such as scanning using smartphone, may be used to determine the spatial orientation. Any change in the spatial orientation indicates tampering. Such change in orientation may occur even when the cap is removed and then reapplied, thereby altering the relationship (howsoever minute) between the security label 208 and the reference 208. Hence, the security label 208 indicates tampering upon machine-scan despite same the cap 204 and the same sealing layer 208 being used again on same container or a different container.

In an embodiment, when the security label 208 is to be scanned with respect to the reference 210, the security label may scannable, in the desired way, only when cap 204 (cap 204 has the reference 210) remains applied over the security label 208.

Second Embodiment

Figure 3C:
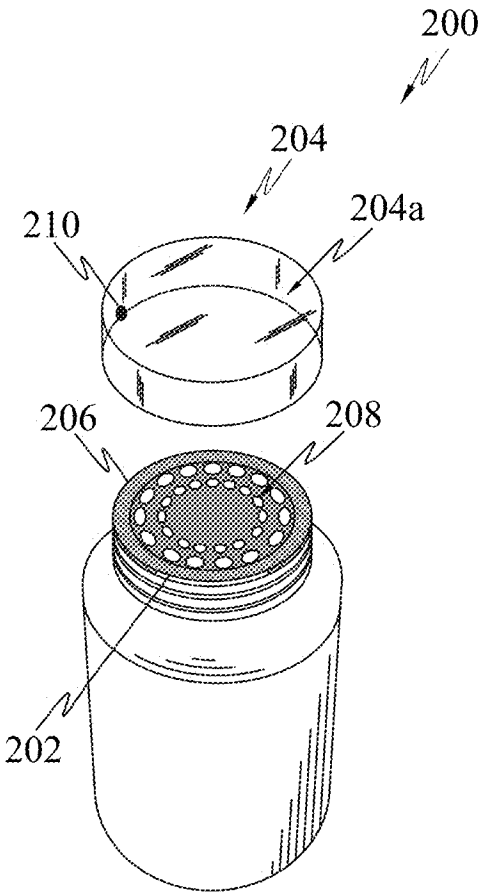
Figure 3B:
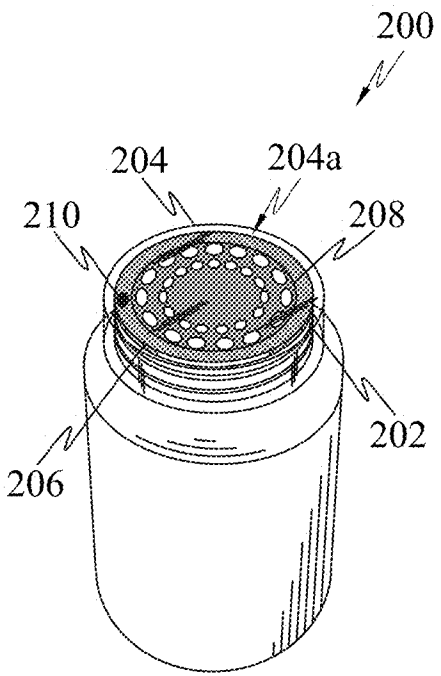
Figure 3A:
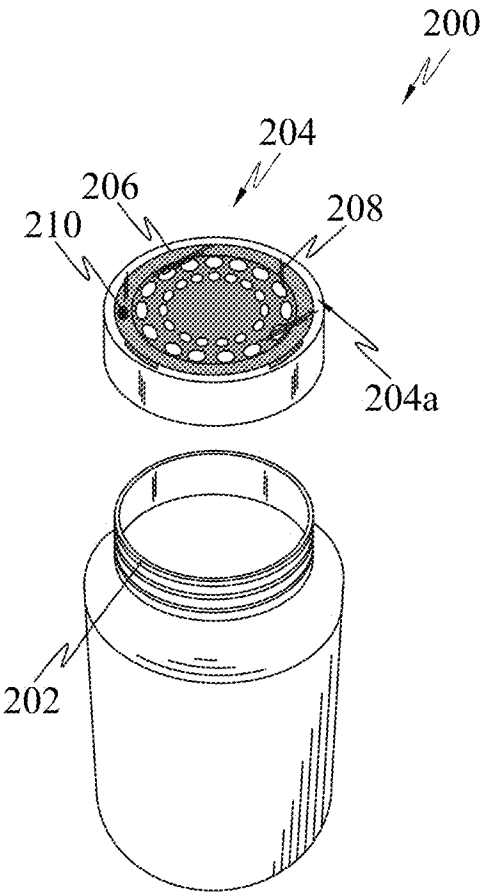

Referring specifically to FIGS. 3A-3C, we now discuss a variation of the previously discussed first embodiment. In this embodiment, the security label 208 is integrated inside the cap 204, with the security label 208 facing the sealing of the cap 204. It may be noted that, the instant integration is before the cap 204 is engaged to the container 200 during the container 200 filling process in a manufacturing facility. Thereafter, during the cap sealing process, wherein the cap 204 is engaged to the container 200 after the container is filled with desired item, the security label 208 is transferred along with the sealing layer 206 to and over the mouth 202 of the container 200.

The embodiment provides for a method of enabling detection of tampering via machine scanning. The method includes obtaining randomized orientation of the machine scan-able security label 208 by disposing the security label 208 inside the capping system 204 of the container 200, such that once the cap 204 is sealed, orientation of the security label 208 is randomized.

Third Embodiment

Figure 4C:
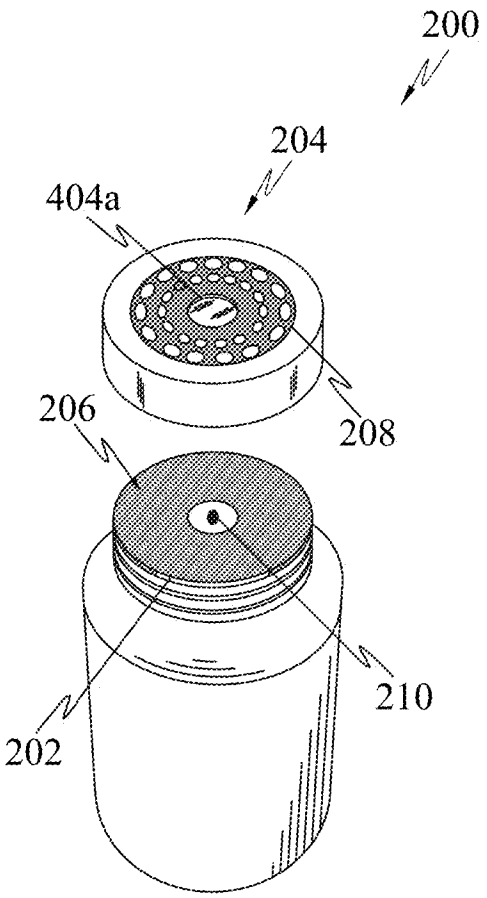
Figure 4B:
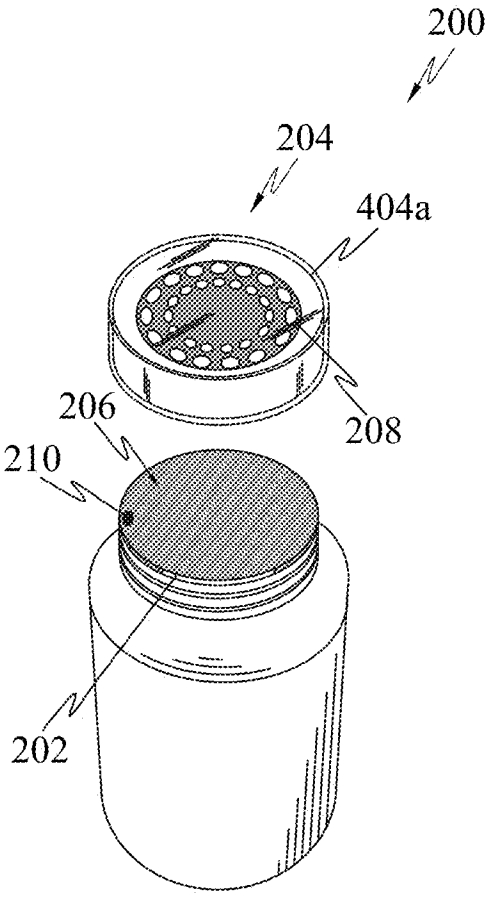
Figure 4A:
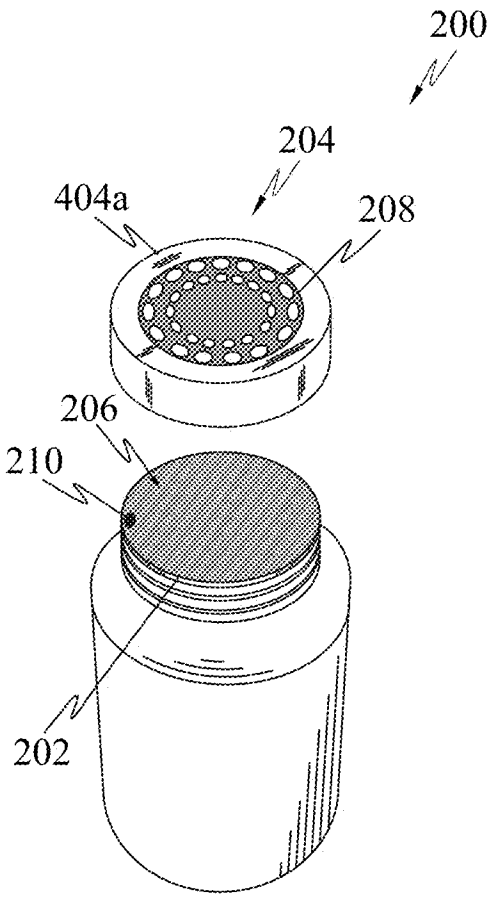

Referring specifically to FIGS. 4A-4C, we now discuss a variation of the previously discussed embodiments. In this embodiment, security label 208 is integrated with the cap 204. The security label may be disposed on the top surface of the cap 204 as illustrated in FIG. 4A, or disposed on the bottom surface of the cap 204 as illustrated in FIG. 4B. The reference 210 is provided on the sealing layer 206. The reference 210 enables determination of spatial orientation of the security label 206 for tamper evidence and counterfeit evidence.

The size of the security label 206 may be such that the top portion (sealing) of the cap 204, despite the security label 206 being integrated to it, still retains a portion 404*a* that is transparent, such that the reference 210 is visible for machine scanning. As an example, dimension of the security label 206 may be smaller than the dimension of the top portion (roof) of the cap 204, and the security label 206 is concentrically placed to the top portion (roof) of the cap 204. Further, the reference 210 is placed within portion of the security label 206, which is visible via the portion 404*a* that retains transparency. As a further example, the security label 206 may be circular in shape, with diameter less than diameter of the roof of the cap 204. As yet another example, the security label 206 may be circular in shape, with a hole at the center, as illustrated in FIG. 4C.

Specifically referring to FIG. 4B, the embodiment provides for a method of enabling detection of tampering via machine scanning. The method includes obtaining randomized orientation of the machine scan-able security label 208 by disposing the security label 208 inside the capping system 204 of the container 200, such that once the cap 204 is sealed, orientation of the security label 208 is randomized.

Fourth Embodiment

Figure 5B:
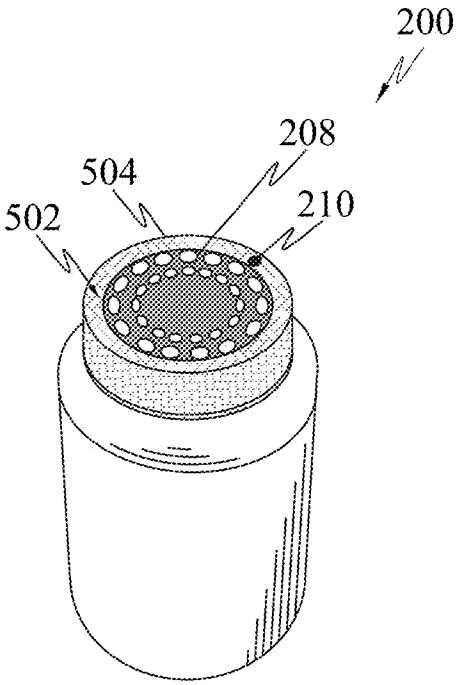
Figure 5A:
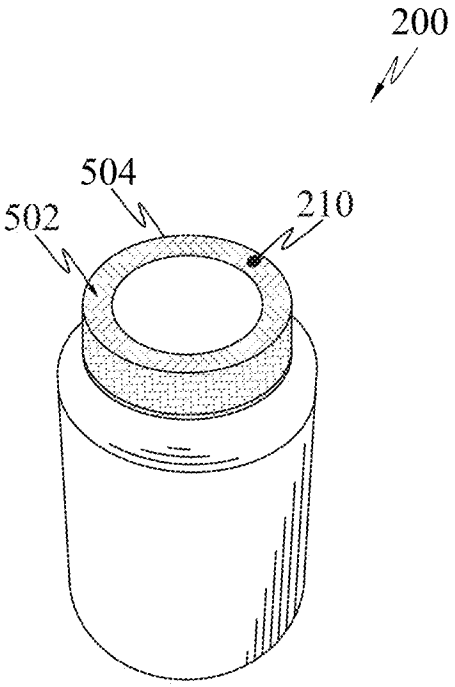

Referring specifically to FIGS. 5A-5B, we now discuss a variation of the previously discussed embodiment. In an embodiment, the cap 504 need not necessarily be transparent. The security label 208 may be disposed at least partially over the cap 504 as illustrated in FIG. 5B. The security label 208 is machine scannable and indicates tampering despite same cap 504 and same sealing layer 206 being used again on same container 200 or another identical container. The container 200 further comprises a shrink sleeve 502 spanning at least partially over the cap 504.

In an embodiment, wherein the security label 208 is at least partially disposed over the shrink sleeve 504, a portion of the security label 208 directly sticks to/interfaces with/printed on a portion of the roof of the cap 504, and another portion of the security label 208 directly sticks to/interfaces with/printed on a portion of the shrink sleeve 502.

The reference 210 may be provided in the shrink sleeve 502, wherein the reference 210 enables determination of spatial orientation of the security label 208. The security label 208 enables indication of tampering despite same label 208 being decoupled and applied again on same container 200 or another container.

Fifth Embodiment

Figure 6:
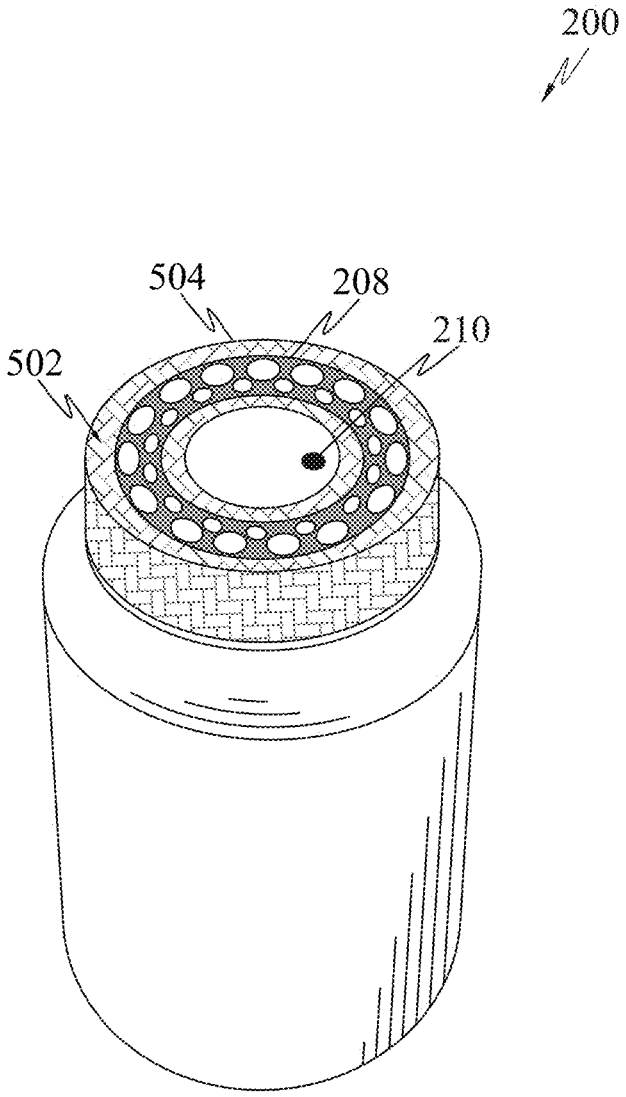

Referring specifically to FIG. 6, we now discuss a variation of the previously discussed embodiment. In this embodiment, the reference 210 is on the container 200 and the security label 208 is disposed on the shrink sleeve 502. The security label 208 enable indication of tampering despite same label 208 being decoupled and applied again on same container 200 or another container.

Sixth Embodiment

Figure 7B:
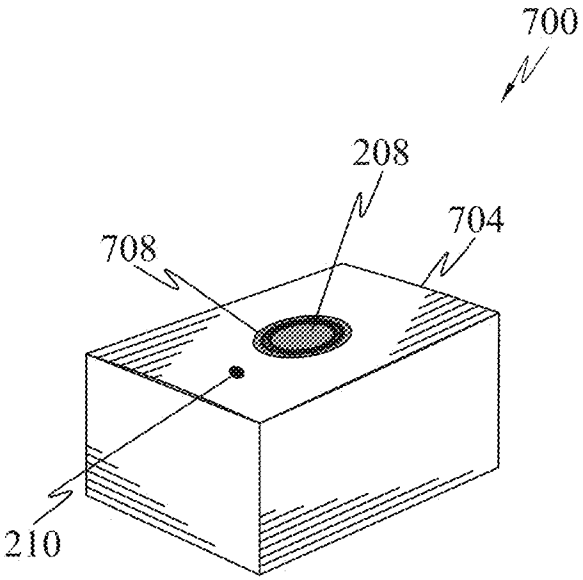
Figure 7A:
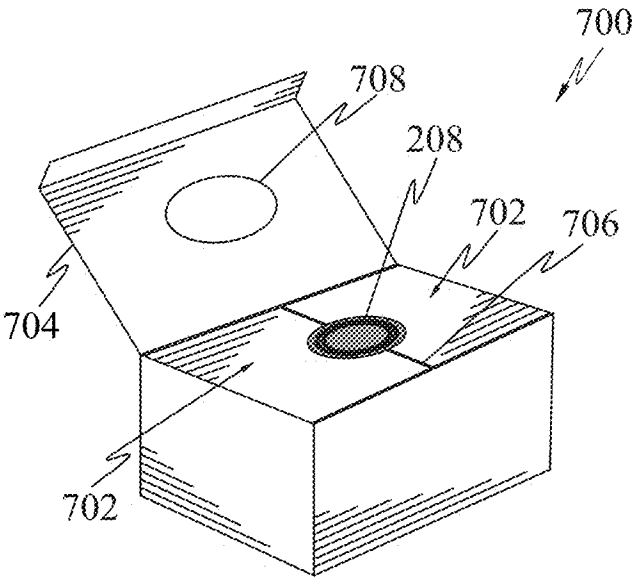

Having discussed integration of security label with capped containers, we now move on to integration of security label with boxed packages/cartons, with specific reference to FIGS. 7A-7B. A packing carton box 700 is disclosed. The box comprises at least two internal closing flaps 702, at least one outer closing flap 704 and at least one security label 208.

The outer closing flap 704 defines at least one transparent portion 708. In an embodiment, the transparent portion 708 may be a punch hole (as illustrated). In another embodiment, the transparent portion 708 may have a transparent material (not illustrated).

The security label 208 at least partially seals the internal closing flaps 702. The internal closing flaps 702 close towards each other to define a recess 706 therebetween. The security label 208 is placed over at least a part of the recess to seal the internal closing flaps 702. The security label 208 is placed such that the security label 208 coincides with the transparent portion 708 when the outer closing flap 704 is closed (refer FIG. 7B). Therefore, at least a part of the security label 208 is visible for scanning via the transparent portion 708.

The box 700 may further comprise a reference 210. The reference 210 enables determination of spatial orientation of the security label 208. The security label 208 can be scanned with respect to the reference 210 when the outer closing flap 702 is in the closed state. The reference 210 may be provided over the outer closing flap 702. There should not be any assumption about direction of movement of outer and internal flaps towards closure of box and FIGS. 7A and 7B are only illustrative,

Seventh Embodiment

Figures 8A, 8B, 8C:
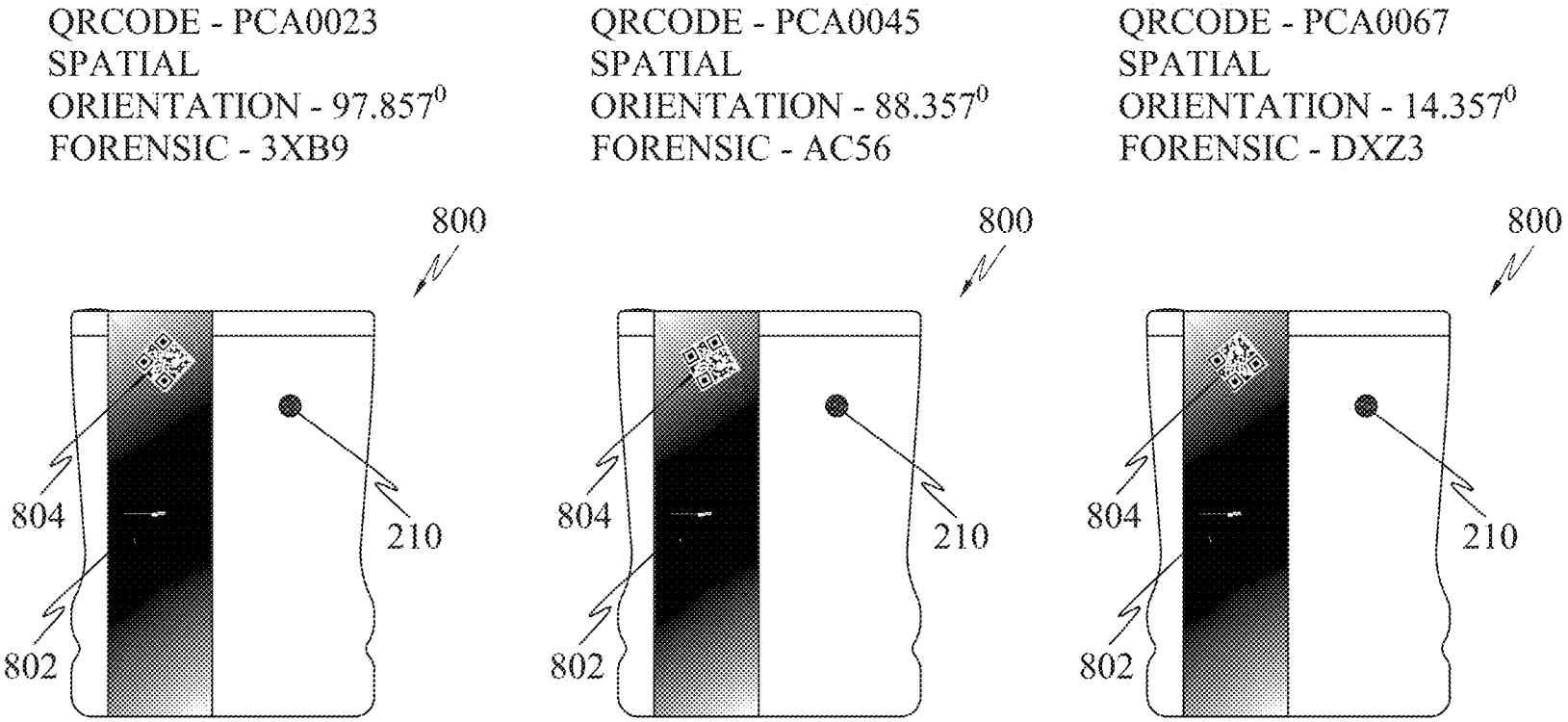

Referring specifically to FIGS. 8A-8C, we now discuss an embodiment wherein a packaging surface has a region with variable color-shift optical property. Packaging containers 800 are disclosed. The container 800 comprises a region 802 with variable color-shift optical property. Color-shift can happen with angle of incident-light, illumination or angle-of-viewing. Further, variable data in encoded form 804 for machine scan is disposed on the region 802. The variable data in encoded form 804 may be matrix barcode as an example. For example, encoded form can be QR code and its corners can be visually distinguished markers. The variable data in encoded form 804 may be disposed with random spatial orientation over the region 802 with color-shift optical property. Unique credential of packaging may be based on color profile along one or more visually distinguished markers within the variable data in encoded form 804. Color profile may be based on combination of spatially random disposition of encoded data on the region 802 with color shift optical property. Scanning and recording color profile may be carried out with flash-light on or flash-light off to detect change in color-profile, which shall not happen in case of duplicated version.

The packaging container/surface 800 may further include a reference 210. The reference 210 may be external to the variable data in encoded form 804. Encoded data can be disposed with known orientation (for example based on value of encoded-data or time-of-generation or combination of both). Orientation is with respect to external reference and stored in database or printed side-by-side for subsequent authentication. A second unique credential may be registered based on orientation of the one or more visually distinguished markers with respect to the external reference 210. During authentication-scan, orientation is again computed with respect to external reference and matched with one stored in database or printed side-by-side, as the case may be. To prevent duplication authentication, scan may also take credential based on color-profile as described above. This embodiment is more suitable for use-case with space constraint requiring mostly counterfeit-evidence. External reference can be printed mark, punch-hole, another encoded data, simply edge of packaging or even be in virtual form as marker on screen of scanning device.

Eighth Embodiment

Figure 9:
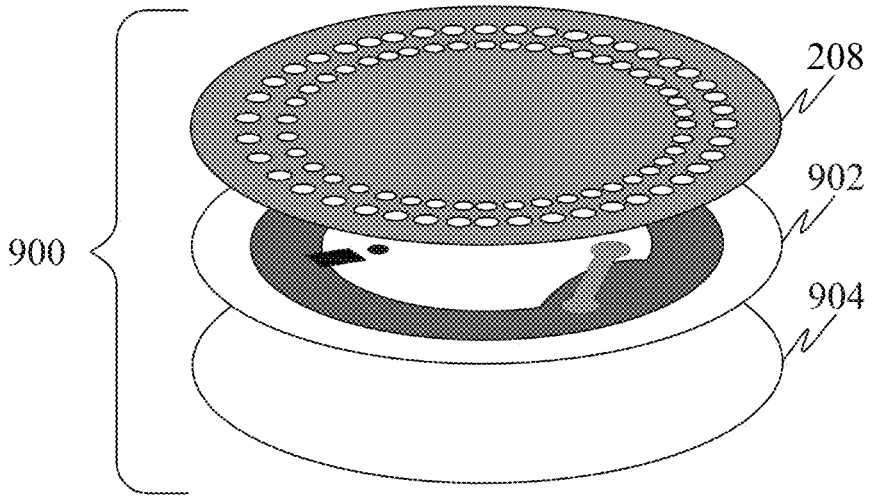

Referring specifically to FIG. 9, we now discuss an embodiment wherein NFC tag 902 and security label 208 are integrated with an adhesive layer 904. Such an integration 900, as an example may be used in the packaging containers/boxes of the earlier discussed embodiments. The NFC tag 902 and the security label 208 are applied to the container. The security label 208 is disposed over face-stock of the NFC tag 902. The packaging further comprises a reference as discussed earlier. The reference enables determination of spatial orientation of the security label 208 for tamper evidence and counterfeit evidence.

NFC can enable smart tracking like time/temperature and hence excellent for tracking. However, NFC is not good for last mile authentication use case. NFC generally does not have any visual feature. Furthermore, in case of NFC, there is absence of differentiation between original-defective or fake-damaged as both will not scan, and hence can be misused. Further, non-cloneable NFC is many times costlier than cloneable version. The integration of the security label discussed earlier with relatively cheaper cloneable NFC, imparts non-clonability. Such integration renders 2-factor technology tag, viz., security label being vision technology and NFC being RF (radio frequency) technology. A smartphone application may scan both in one single scan. Special advantage of integrating security label with NFC is that, while NFC is pre-programmed, security label (with respect to a reference) gets "auto-programmed" only when applied on packaging.

Ninth Embodiment

Figure 10C:
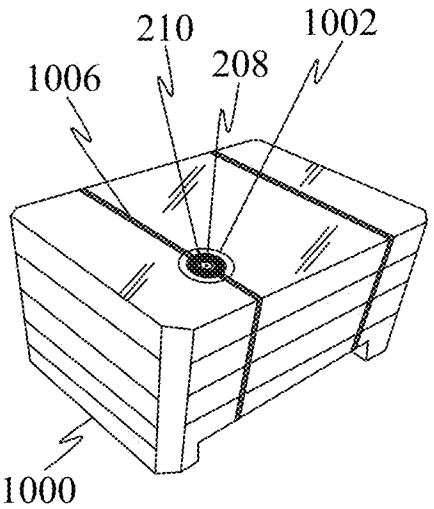
FIG. 10C illustrates a top view of a strap 1006 passing through the groove 1004 of the widget 1002, and the security label 208 applied over the groove 1004 and the strap 1006, in accordance with an embodiment.
Figure 10B:
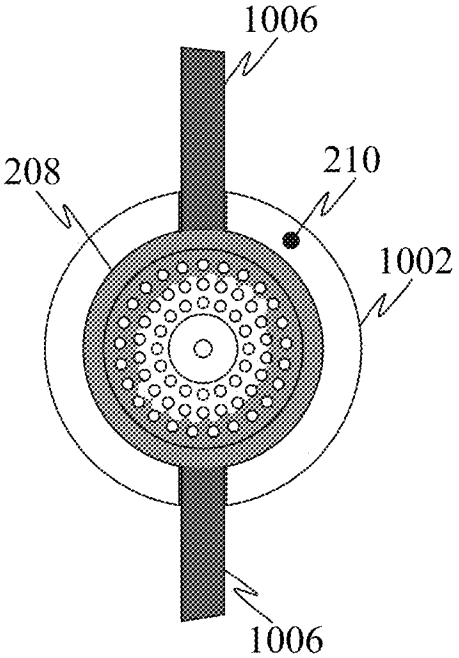
FIG. 10B illustrates the security label 208 integrated with a carton/pallet 1000 using the widget 1002 of FIG. 10A, in accordance with an embodiment.
Figure 10A:
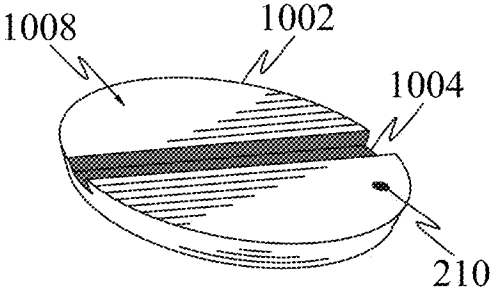
FIG. 10A illustrates a widget 1002 with a groove 1004 for receiving a strap for integrating security label with cartons or pallets, in accordance with an embodiment.

Referring specifically to FIGS. 10A-10C, we now discuss an embodiment in which security label 208 is integrated with strapping.

A packaging container 1000 is disclosed. The packaging container 1000 is sealed with straps 1006. At least one of those straps 1006 passes through a groove 1004. The security label 208, which is machine scannable, is disposed over at least a section of the groove 1004 and the strap 1006. The groove 1004 is defined by a widget 1002. The widget 1002 comprises a flat surface 1008, wherein the flat surface 1008 defines the groove 1004 therein. The security label 208 is received over the flat surface 1008 (thereby facilitating accurate scanning).

The packaging container 1000 may further comprise a reference 210, wherein the reference 210 enables determination of spatial orientation of the security label 208 for tamper evidence and counterfeit evidence. The reference 210 may be provided over the flat surface 1008 of the widget 1002 (as illustrated), on the container 1000 or on the strap 1006.

It may be noted that the security labels of various embodiments discussed earlier may be machine scannable for counterfeit evidence.

It may be noted that the security labels of various embodiments may be manifested in form of encoded variable data whose spatial orientation is determined with respect to a reference external to the security label.

In the foregoing detailed description, numerous specific details, examples, and scenarios are explained in order to facilitate a thorough understanding of the present disclosure. However, the embodiments of the disclosure may be practiced without such specific details. Further, such examples and scenarios are provided for illustration, and are not intended to limit the disclosure in any way. Those of ordinary skill in the art, with the included descriptions, should be able to implement appropriate functionality without undue experimentation. Thus, the scope of the invention should be determined by the appended claims and their legal equivalents rather than by details, examples, and scenarios provided.

It shall be noted that the processes described above are described as sequence of steps; this was done solely for the sake of illustration. Accordingly, it is understood that some steps may be added, some steps may be omitted, the order of the steps may be re-arranged, or some steps may be performed simultaneously.

Although embodiments have been described with reference to specific example embodiments, it will be evident that various combinations, modifications, additions, and omissions may be made to these embodiments without departing from the broader spirit and scope of the foregoing disclosure and appended claims. Accordingly, the specification and drawings are to be regarded in an illustrative sense rather than a restrictive sense.

It is to be understood that the phraseology or terminology employed herein is for the purpose of description and not of limitation.

What is claimed is:

1. A packaging for a container comprising a mouth and a cap, the packaging comprising a shrink sleeve, a reference and a security label which comprises a pattern, wherein:

the security label is disposed either on the cap or the shrink sleeve;

the reference is provided on the other of the cap or the shrink sleeve;

the pattern and the reference are machine scannable;

the shrink sleeve shrinks to take a final shape, to seal the cap, whereby as the shrink sleeve shrinks, one of the pattern and the reference provided on the shrink sleeve undergoes a change, as a result of shrinking of the shrink sleeve;

a random spatial orientation of security label relative to the reference is generated, wherein the random spatial orientation is based on the final shape of the shrink sleeve and the changed pattern or the reference;

the machine scan enables determination of spatial orientation of the security label relative to the reference; and the machine scan, based on the change in the spatial orientation, indicates tampering despite the same cap or a copy of the shrink sleeve being reapplied to the previously applied container or a different container.

2. A method of packaging of a container comprising a mouth and a cap, the packaging comprising a shrink sleeve, a reference and a security label which comprises a pattern, the method comprising:

disposing the security label either on the cap or the shrink sleeve;

providing the reference on the other of the cap or the shrink sleeve, wherein the pattern and the reference are machine scannable;

sealing of the cap by shrinking the shrink sleeve to cause the shrink sleeve to take a final shape, whereby as the shrink sleeve shrinks, one of the pattern and the reference provided on the shrink sleeve undergoes a change, as a result of shrinking of the shrink sleeve;

generating a random spatial orientation of security label relative to the reference by shrinking the shrink sleeve to acquire the final shape, wherein the random spatial orientation is based on the final shape of the shrink sleeve and the changed pattern or the reference; and determining by a machine scan the spatial orientation of the security label relative to the reference, wherein the machine scan, based on the change in the spatial orientation, indicates tampering despite the same cap or a copy of the shrink sleeve being reapplied to the previously applied container or a different container.

* * * * *